United States Patent [19]

Felland et al.

[11] 4,291,213

[45] Sep. 22, 1981

[54] LEVER OPERATOR SWITCH ACTUATOR

[75] Inventors: Richard A. Felland, Waterloo; James A. Miller, Cedar Falls, both of Iowa

[73] Assignee: Deere & Company, Moline, Ill.

[21] Appl. No.: 189,479

[22] Filed: Sep. 22, 1980

[51] Int. Cl.[3] ..... H01H 21/24

[52] U.S. Cl. ..... 200/335; 200/153 T; 200/293; 200/6 A

[58] Field of Search ..... 200/335, 153 T, 6 A, 200/293

[56] References Cited

U.S. PATENT DOCUMENTS

| | | | |
|---|---|---|---|
| 1,865,697 | 7/1932 | Karrer | 200/6 A |
| 2,801,308 | 7/1957 | Cubellis | 200/153 T |
| 3,397,372 | 8/1968 | Maxwell | 200/153 T |
| 4,237,629 | 12/1980 | Schmidt | 200/6 A |

FOREIGN PATENT DOCUMENTS

| | | | |
|---|---|---|---|
| 853395 | 11/1960 | United Kingdom | 200/6 A |
| 985298 | 3/1965 | United Kingdom | 200/6 A |

*Primary Examiner*—Willis Little

*Attorney, Agent, or Firm*—Henderson & Sturm

[57] ABSTRACT

A lever operated switch actuator has a resilient lever secured at its lower end to a bracket and having a control knob at its upper end. The bracket is secured to a supporting surface. A pair of switches having plungers are secured to the bracket on opposite sides of the lever. A lever stop member is secured to the bracket and has stops positioned on opposite sides of the lever and immediately above the switch plungers. The stops of the lever stop member are adjustable with respect to the switch plungers. The lever can be manually grasped at the control knob and deflected forwardly or rearwardly to depress a plunger which activates a switch. A lever stop contacts the lever once a plunger is depressed.

2 Claims, 5 Drawing Figures

LEVER OPERATOR SWITCH ACTUATOR

BACKGROUND OF THE INVENTION

The present invention relates to the field of switch actuators, and particularly, to those employing levers.

Typically, lever switch actuators have included various moving parts in sliding contact with one another. To prevent eventual failure or substantially impeded operation, these switches require periodic maintenance and lubrication. There has therefore been a long felt need for a lever operated switch actuator which would eliminate these shortcomings by requiring little or no maintenance and lubrication.

SUMMARY OF THE INVENTION

The present invention overcomes the above-mentioned shortcomings of the prior art by providing a lever-type switch actuator which has no moving parts in immediate sliding contact. The applicants have accomplished this advance in the art by employing a resilient elongated control lever, fixed to a bracket at its lower end, having a control knob at its upper end, and being deflectible forwardly or rearwardly to depress forward or rearward switch plungers to actuate their respective switches. As employed by the applicants, the lever itself acts as a spring being deflectible to an operating position and then returning to its normal resting position once the deflecting force of the operator's hand on the control knob is removed. The present invention includes an adjustable lever stop member which protects the switches by preventing the control lever from depressing the plungers beyond their operating ranges.

It is therefore an object of the present invention to provide an improved lever operated switch actuator.

It is a further object of the present invention to provide a lever operated switch actuator which requires no maintenance or lubrication.

Yet another object of the present invention is to provide a lever operated switch actuator which has no moving parts in sliding contact with one another.

A still further object of the present invention is to provide a lever operated switch actuator which employs a resilient control lever to actuate the switches.

Still another object of the present invention is to provide a lever operated switch actuator which includes an adjustable lever stop means to protect the switches from over-travel of the plungers.

These and other objects, advantages and novel features of the invention will become apparent from the following detailed description of the invention taken in conjunction with the accompanying drawings.

DESCRIPTION OF THE PREFERRED EMBODIMENT

Figure 1:
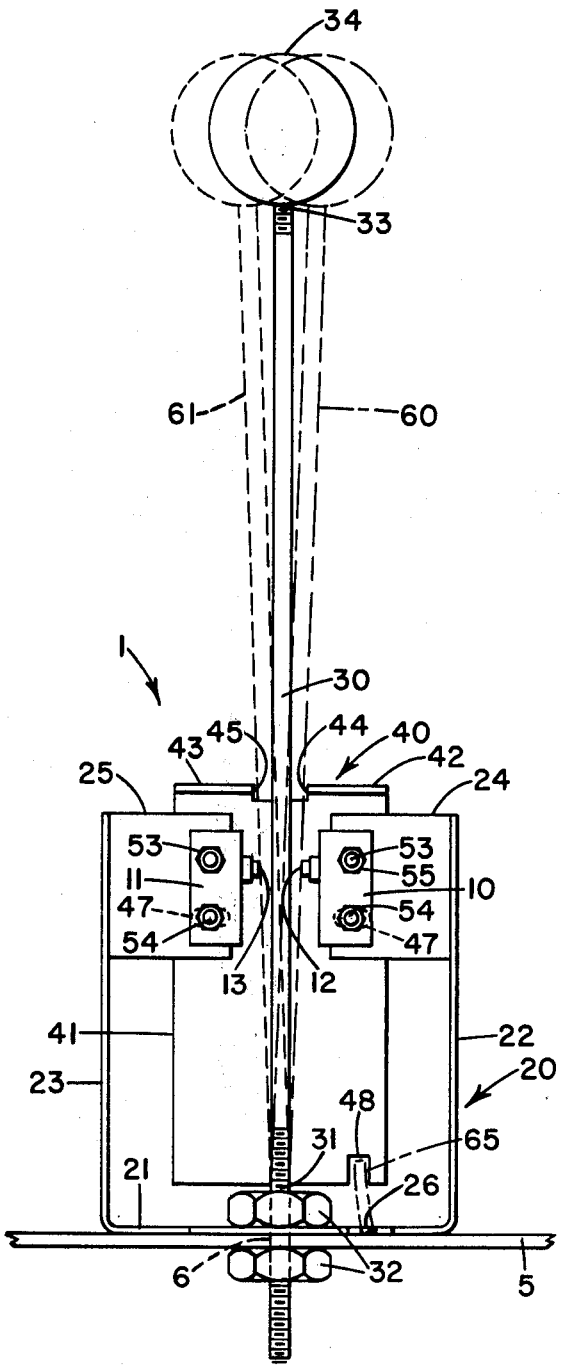
FIG. 1 is a front elevational view of the present invention showing some hidden portions in dotted lines and various operating positions of the invention in phantom lines.
Figure 5:
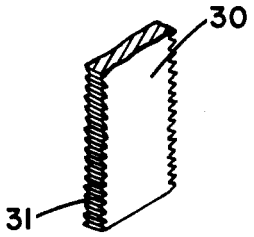
FIG. 5 is a fragmentary perspective of the lower end of the lever.
Figure 2:
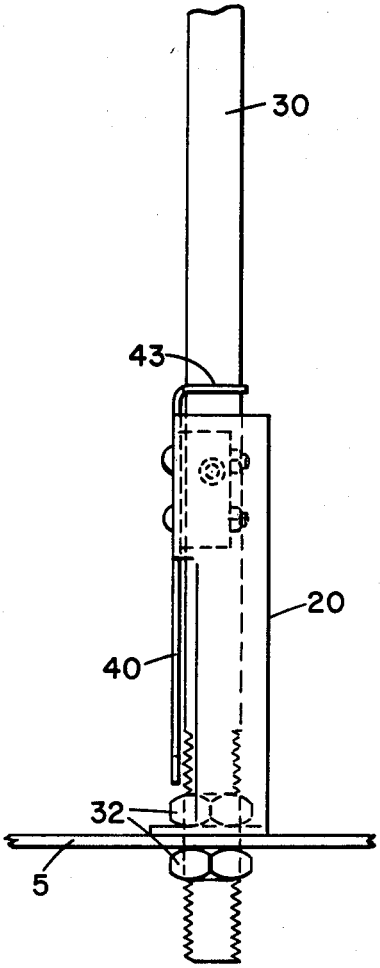
FIG. 2 is a side view of the structure shown in FIG. 1.

In brief overview, the present invention comprises a lever operated switch actuator apparatus 1 wherein a resilient control lever 30, fixed at its lower end to a bracket 20 and having a control knob 34 at its upper end, can be deflected forwardly or rearwardly along a predetermined lever path to activate forward or rearward actuators or switches 10, 11. An adjustable lever stop member 40 is provided to protect the switches 10, 11 from over-travel of the plungers 12, 13.

Now, more particularly, with reference to FIG. 1, the switches 10, 11 are respectively secured to flanges 24, 25 of the generally U-shaped bracket 20 by means of bolts 53, 54, and nuts 55. Switches 10, 11 are of the on-off type, typically to control hydraulic mechanisms, and are actuated by their respective plungers 12, 13. The flanges 24, 25 are normally disposed from the coterminous upper ends of vertical legs 22, 23 of the bracket 20. The legs, in turn, are disposed upward normally from opposite ends of a generally rectangular base member 21 of bracket 20. A first notch 26 is provided in the base 21 to serve a purpose later described.

A suitable aperture 19 (FIG. 3) is provided in base 21 to receive the threaded lower end 31 of the control lever 30. A pair of jam nuts 32 are threadably engaged with the end 31 to secure the lever 30 to the bracket 20, and also to secure the bracket 20 to a suitable support 5, the lower end of the lever passing through an aperture 6 in the support 5. The nuts thus serve to mount both the lever and lever bracket. The support 5 is disclosed as a horizontal supporting surface. It is not essential, however, that the bracket 20 be horizontally supported. Other means of supporting the bracket 20 such as along the legs 22, 23, for example, would, of course, be equally suitable.

Control lever 30 is generally rectangular in cross section with its broadest sides being disposed in a direction parallel to the legs 22, 23. Threading of the lower end at 31 provides threads on only the narrow edges. This orientation and configuration of the lever 30 together with the choice of a suitable resilient material permits deflection towards and away from the switches 12, 13 as will later be described more fully. The upper end 33 of the lever 30 is threaded to secure the internally threaded control knob 34.

Figure 4:
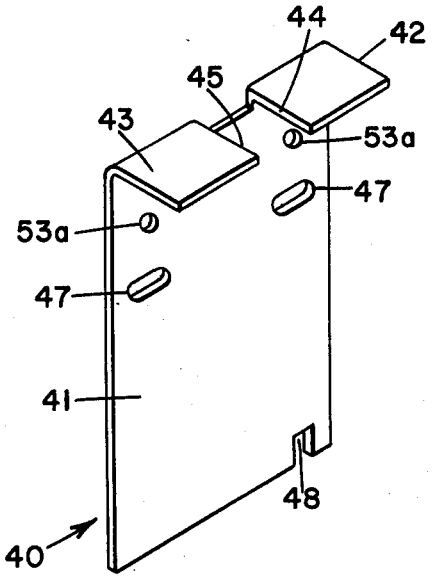
FIG. 4 is a perspective of the lever stop member.
Figure 3:
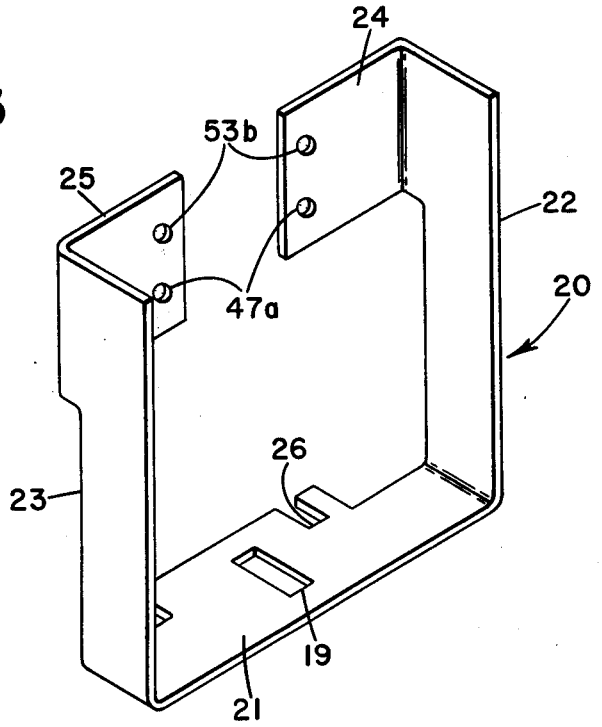
FIG. 3 is a perspective of the supporting bracket.

The assembly is completed by the lever stop member 40. Lever stop 40 has a generally rectangular, vertically disposed face 41 which is secured to the bracket flanges 24, 25 by means of the bolts 53, 54 and nuts 55 which also secure the switches 10, 11 as aforementioned. Upper bolts 53 are received within suitable apertures **53*a* in the face 41 and 53*b* in the leg flanges. Lower bolts 54 are received within horizontal slots 47 in the face and apertures 47*a* in the bracket 20 (FIGS. 3 and 4). The slots 47 in conjunction with a second notch 48 in face 41, and the first notch 26 in bracket 20, provide for adjustment of the lever stop member 40**, as will later be described.

Lever stop member 40 includes a pair of generally horizontal spaced tabs 42, 43 which extend outwardly normal to the upper edge of the face 41. The tabs 42, 43 include inner edges 44, 45, respectively. Forward edge 44 comprises a forward stop while rearward edge 45 comprises a rearward stop for the lever 30.

Having thus disclosed the structure of the preferred embodiment of the present invention, it operates as follows:

To actuate the forward switch 10, the control knob 34 is manually grasped by the operator and moved forwardly, deflecting the lever 30 to the forward operating position indicated by the phantom lines 60. In this forward operating position 60, the plunger 12 is depressed to actuate switch 10, with the forward stop 44 preventing further forward travel of the lever 30 to protect the switch 10 against over-travel of the plunger 12. The analogous situation occurs where the lever 30 is deflected rearwardly to actuate the rearward switch 11. The lever 30 abuts the protective rearward stop 45 and assumes the rearward operating position indicated by phantom lines 61.

To ensure that the stops 44, 45 protect the switches 10, 11 against over-travel of the plungers 12, 13, the present invention also includes a lever stop adjustment mechanism which is comprised of the slots 47, and the first and second notches 26 and 48 as follows:

The adjustment mechanism essentially permits the lever stop 40 to be pivoted with respect to the bracket 20.

To adjust the lever stop member 40, the nuts 55 on the lower bolts 54 are loosened and the blade of a flat screwdriver, for example, is inserted into notches 26, 48 as shown by the phantom lines 65 of FIG. 1. With reference to FIG. 1, the screwdriver would be positioned upward, normally with respect to the paper and the blade 65 of the screwdriver would span the notches 26, 48. With the lower nuts 55 still in a loosened condition, as aforementioned, the screwdriver would be rotated to pivot the lever stop 40 with respect to the bracket 20. The slots 47 together with some resiliency provided in the legs 22, 23 of the bracket 20, permit this pivotal movement, it being noted that the base, legs and lever stop member 40 afford a four-bar linkage, with pivots at 53*a* and "pivots" as the legs deflect. The switches 10, 11 will remain relatively fixed in position as the lever stop member 40 is pivoted, with only the positions of the lever stops 44, 45 changing. Thus, the instant invention permits the position of the stops 44, 45 to be adjusted with respect to the plungers 12, 13 to ensure that the switches 10, 11 are protected from damage due to over-travel. Once the correct setting for stop member 40 is determined, the nuts 55 are tightened on the lower bolts 54 to secure stop member 40 with respect to the bracket 20.

Having thus disclosed the structure and operation of the present invention, it is obvious that many modifications and variations thereof are possible in light of its teachings. It is therefore intended to be understood that, within the scope of the appended claims, the invention may be practiced otherwise than as specifically described.

We claim:

1. Control mechanism for mounting on a horizontal support, comprising: U-shape bracket means having a flat base abutting the support and fore-and-aft spaced apart front and rear legs integral with the base and rising therefrom to co-terminous upper ends, said ends respectively having flanges disposed in a common, fore-and-aft upright plane and directed toward each other and spaced apart fore and aft; means affixing the base of the bracket means to the support; a member in the form of an inverted L having a first part depending flatwise alongside the flanges and a second part extending laterally over the flanges and overlying and spaced above the base of the bracket means, said second part having a rectangular notch therein including front and rear laterally directed stop edges spaced apart fore and aft less than the fore-and-aft spacing of the bracket means legs; an elongated, upright control lever having a lower end affixed to the support and extending upwardly through the notch in substantially centered relation to the stop edges, said lever being of resilient material so as to be selectively deflectible fore and aft in a range limited by the stop edges, said lever being recoverable to resume its substantially centered position; and front and rear actuators disposed respectively adjacent to the front and rear flanges of the bracket means to be selectively engaged by fore-and-aft movement of the lever; and front and rear means respectively securing the actuators to the flanges and to the first part of the L-shaped member, said front and rear securing means being selectively releasable and re-securable, and the legs of the bracket means being deflectible fore and aft upon release of the said rear securing means so as to enable selective fore-and-aft changes in the position of the notch, re-securing of said front and rear means serving then to retain the deflected positions of the legs and the changed position of the notch.

2. The control mechanism of claim 1, in which the means affixing the base of the bracket means to the support also affixes the lower end of the control lever to the support.

* * * * *

UNITED STATES PATENT AND TRADEMARK OFFICE

CERTIFICATE OF CORRECTION

PATENT NO. : 4,291,213

DATED : 22 September 1981

INVENTOR(S) : Richard A. Felland and James A. Miller

It is certified that error appears in the above—identified patent and that said Letters Patent is hereby corrected as shown below:

Page 1, line [54], change Title to read -- LEVER OPERATED SWITCH ACTUATOR --.

Signed and Sealed this

*Eighth* Day of *June 1982*

[SEAL]

*Attest:*

GERALD J. MOSSINGHOFF

*Attesting Officer*

*Commissioner of Patents and Trademarks*